US005435925A

United States Patent [19]

Jamison

[11] Patent Number: 5,435,925

[45] Date of Patent: Jul. 25, 1995

[54] POLYETHYLENE LUBRICANT-DISPENSING COMPOSITIONS

[75] Inventor: Warren E. Jamison, Edmonds, Wash.

[73] Assignee: E/M Corporation, West Lafayette, Ind.

[21] Appl. No.: 106,117

[22] Filed: Aug. 13, 1993

[51] Int. Cl.[6] ..... C10M 143/02; C10M 157/00

[52] U.S. Cl. ..... 252/12; 252/12.002

[58] Field of Search ..... 252/12, 12.2

[56] References Cited

U.S. PATENT DOCUMENTS

| | | | |
|---|---|---|---|
| 3,541,011 | 11/1970 | Davis et al. | 252/12 |
| 3,547,819 | 12/1970 | Davis et al. | 252/12 |
| 3,729,415 | 4/1973 | Davis et al. | 252/12 |
| 3,779,918 | 12/1973 | Ikeda et al. | 252/12.6 |
| 3,883,464 | 5/1975 | Higuchi et al. | 260/30.4 R |
| 3,985,661 | 10/1976 | Ikeda et al. | 252/12 |
| 4,041,002 | 8/1977 | Aboshi et al. | 260/30.6 R |
| 4,111,886 | 9/1978 | Lindner et al. | 260/31.8 T |
| 4,448,700 | 5/1984 | Lankamp | 252/12.4 |
| 4,787,991 | 11/1988 | Morozumi et al. | 252/12.4 |
| 4,829,093 | 5/1989 | Matsukawa et al. | 521/53 |
| 4,915,856 | 4/1990 | Jamison | 252/26 |
| 5,049,606 | 9/1991 | Yamaya et al. | 525/149 |
| 5,079,287 | 1/1992 | Takeshi et al. | 524/528 |

OTHER PUBLICATIONS

W. E. Jamison et al., "Oil Filled Microporous Polymer Lubricants", NLGI 48th Annual Meeting, (Oct. 1980).

W. E. Jamison et al., "New Developments in Microporous Polymer Lubricants", Lubrication Engineering, (May 1985), vol. 41, pp. 274–279.

*Primary Examiner*—Jacqueline V. Howard

*Attorney, Agent, or Firm*—Ronald M. Anderson

[57] ABSTRACT

Solid lubricant-dispensing plastics containing: polyethylene with a molecular weight of about 200–700,000; an oil; an optional compatibilizing agent for the oil; and, a bleed control agent that controls the rate of release of the oil. Methods are also disclosed for preparing the lubricant-dispensing plastics that have controlled oil release rates that are dependent upon the amount of the bleed control agent, and are adjustable by changing oil viscosity and the initial amount of the oil in the formulation.

15 Claims, 9 Drawing Sheets

POLYETHYLENE LUBRICANT-DISPENSING COMPOSITIONS

FIELD OF THE INVENTION

The invention is generally related to solid lubricant compositions, and more specifically, to lubricant-dispensing polyethylene plastic compositions.

BACKGROUND OF THE INVENTION

Polyethylene is a prototype polymer with a simple molecular structure, which is widely used in forming articles subject to lightly loaded sliding contacts, such as furniture feet and drawer glides. Polyethylenes can exist in a wide range of states, with vastly different physical properties. For example, low molecular weight polyethylene molecules are gases or liquids; at about 20,000 molecular weight, polyethylene is considered a plastic; and, up to about 500,000 molecular weight, polyethylene is generally considered suitable for injection molding and extrusion. "Very high molecular weight" polyethylene has a molecular weight between about 500,000 and 1,000,000 and "ultrahigh molecular weight polyethylene" (abbreviated UHMWPE) has a molecular weight between about 1,000,000 and 5,000,000, UHMWPE is generally only processable by compression molding and ram extrusion.

In polymeric materials, polyethylene chains can exist simultaneously in any one of three states, namely: an amorphous state containing randomly enterwined molecules; a crystalline state with neatly arranged dense packing of molecules; or, an oriented state produced by partial orientation of molecules during polymer processing. While it is highly desirable to manufacture materials having a given molecular orientation, the results are still largely unpredictable, especially when formulated with additives.

Several polyethylene polymers have been disclosed that successfully incorporate lubricating oils, which may bleed to the surface and perform a lubricating function. Agens (U.S. Pat. No. 3,135,564) formulated such a lubricant from vinyl chloride. Davis (U.S. Pat. No. 3,541,011; U.S. Pat. No. 3,547,819; U.S. Pat. No. 3,729,415 teaches formulation of a lubricant dispensing oil from an UHMWPE sometimes in combination with certain lower molecular weight polyethylenes. Rumierz (U.S. Pat. No. 4,146,487) disclosed similar results by formulating compositions with polymethyl pentene, having a range of molecular weights between 3,000,000 and 5,000,000. Jamison, the inventor of the subject invention, in an earlier patent (U.S. Pat. No. 4,486,319) disclosed that lubricants might be formulated using ionomer polymers. Baile (U.S. Pat. No. 4,239,632) disclosed certain properties of oil-exuding plastics and modification with a solid additive designed to conduct away frictional heat. Jamison in an earlier patent (U.S. Pat. No. 4,915,856) describes a lubricating composition formulated from certain polymers, oils, and both solid and liquid additives. Takeshi et al. (U.S. Pat. No. 5,079,287) disclosed formulations with at least 10.5% of UHMWPE. In general, all the former lubricant compositions using UHMWPE suffer from common disadvantages, namely, that UHMWPE is poorly formable by injection molding or extrusion, and that bleed rates of oil from the lubricant compositions are poorly controlled even when using a standardized, rigidly controlled manufacturing process.

Several attempts have been made in the art to control bleed rate from polyethylene polymers. Ikeda and Kawakita (U.S. Pat. No. 3,779,918) describe polyethylene polymers formulated with oil adsorbed onto either a graphite carrier, a polymer powder such as Hostalen GUR, or a natural fiber such as cotton. The process of forming the latter polymer reportedly fuses the oil and carrier adsorbent into the polymer. A requirement that the carrier have a higher thermal stability than the base resin suggests that the resultant composition remains a two-phase material at all times during; and after molding. Ikeda and Ishikawa (U.S. Pat. No. 3,985,661) similarly disclose formulation of a lubricant composition from carrier adsorbed oil, wherein the oil remains as a second phase in the resultant polymeric material. U.S. Pat. No. 4,829,093 also pertains to the absorption of oil onto a preformed carrier, but does not teach how to control the subsequent release of oil from within polymeric structure. In general, two-phase systems for controlling bleed rates are disadvantageous for the following reasons: first, the resulting polymer is structurally weakened by inclusion of oil and carrier adsorbent; and, second, the bleed rate of the oil from within the polymer-carrier matrix is still poorly controlled.

Aside from the use of polyethylenes, several prior art attempts have been made to formulate other polymeric compositions with controlled bleed rates. Landkamp, U.S. Pat. No. 4,448,700, reportedly formulated a polymeric material of polypropylene or a mixture of polypropylene and nylon as a resin, using a polyol ester as the lubricant. Since the latter disclosure specifies the use of a certain type of synthetic oil, the compositions may not (in practice) be widely applicable. Aboshi et al. (U.S. Pat. No. 4,041,002) reportedly formulated an ethylene-vinyl acetate (EVA) copolymer with an acetal base resin. Since acetal will not dissolve any oil, the oil must be dissolved in the EVA. Matsukawa and Ishioka (U.S. Pat. No. 4,829,093) discuss the use of a microporous styrene-divinyl benzene additive to incorporate oil into a polymeric composition, but oil viscosity must reportedly be decreased with a solvent to prepare the disclosed composition.

Thus, although the desirability has been recognized in the art of polymeric lubricant compositions having a controlled bleed rate of oil, the prior art has not recognized how to formulate and extrude these materials, how to control bleed rate, or how to reduce the rate of release of a lubricating oil from within the structure of a polyethylene.

SUMMARY OF THE INVENTION

The present invention relates to thermoplastic lubricant-dispensing plastic (LDPs) materials that bleed oil onto their surface at a standardized rate, which is controlled through the inclusion of a measured amount of a "bleed control agent." The bleed control agent acts to reduce the natural rate of release of the lubricating oil from within the polymeric structure. The invention furthermore involves a method for preparing the LDP materials, which allow them to be formed into useful objects by injection molding, extrusion, or other processes used for thermoplastic polyethylene materials.

DETAILED DESCRIPTION OF THE PREFERRED EMBODIMENT

Figure 1:
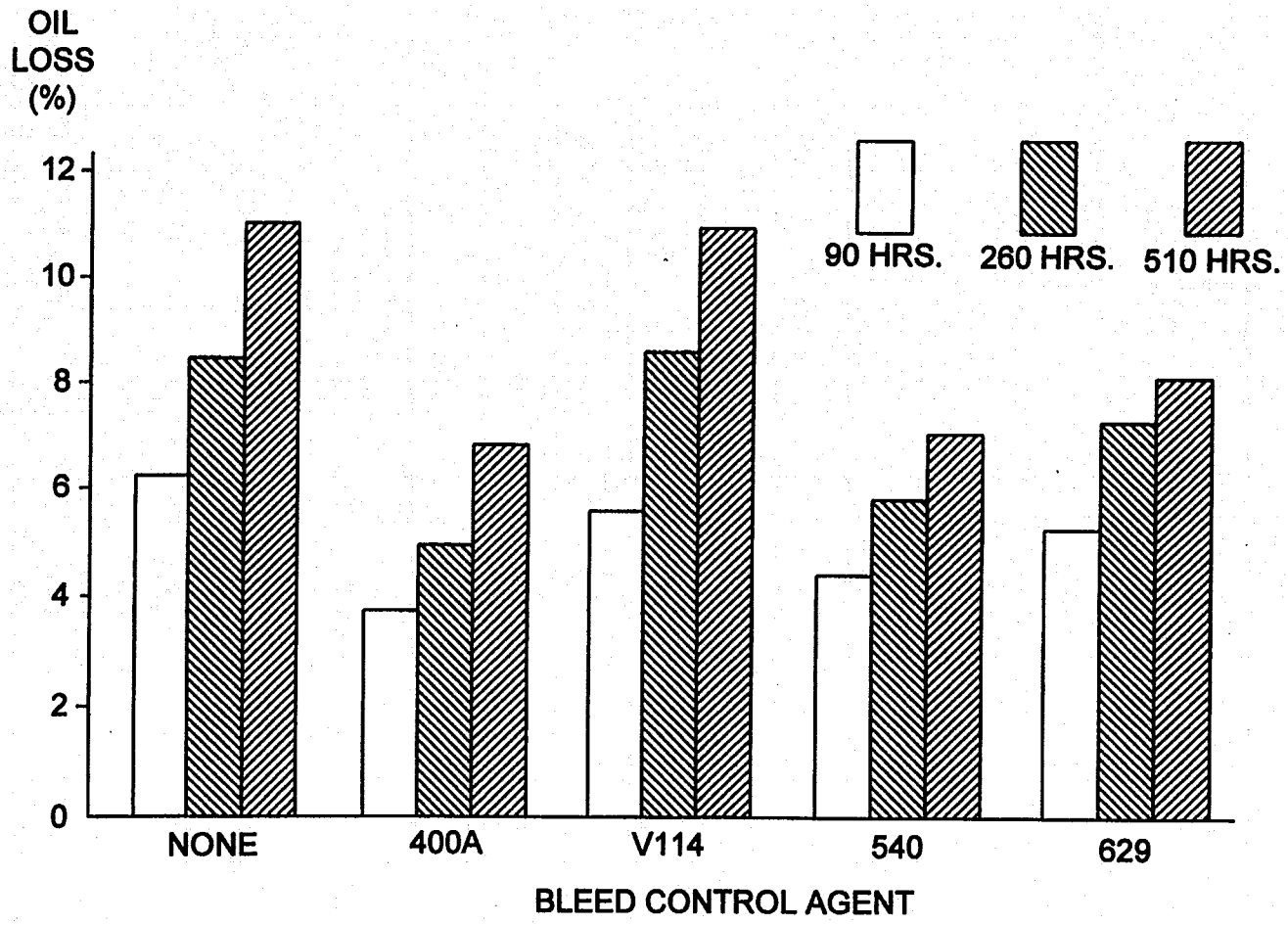
FIG. 1 graphically depicts the effect of four different bleed control agents (BCA) at 5% w/w concentration on the percentage of ISO 320 oil released over time at room temperature (about 36° C./65° F.) from a polyethylene lubricant dispensing plastic (65% w/w) with an original oil concentration of 30% by weight.

The inventor recognized that lubricant dispensing plastics (LDPs) incorporating UHMWPE, such as those described by Davis (above), generally do not form acceptable materials when injection molded or extruded, for at least the following five reasons. First, segregation is apparent within the extruded or molded polymer and causes poor dimensional control. Second, surface finish is poorly formed and not uniform, requiring additional finishing before the product is ready for its intended purpose. Third, following extrusion or molding, the surface layers of the UHMWPE lubricant polymers have a tendency to peel off, leaving pits, holes, and surface roughness. Fourth, UHMWPE base polymers have poor flow characteristics when melted and are difficult to use in molds. Finally, the rate of expulsion of oil from materials prepared with UHMWPE varies greatly, depending in part, upon the concentration of oil within the composition, the use temperature, and other manufacturing and operational factors, so that in practice, it is quite difficult to manufacture a standardized product.

It is an object of the present invention to provide compositions having physical and tribological properties that solve these five problems. It is also an object of the invention to provide thermoplastic, lubricant-dispensing polyethylene compositions that can be molded and extruded to provide useful objects with good dimensional control and good surface properties. It is a further object of the invention to provide lubricant-dispensing polyethylene compositions in which the rate of oil dispensation can be adjusted and/or controlled and standardized to meet the requirements of a particular end-use.

The term "LDP" is used herein to refer to a finished polyethylene thermoplastic that contains both oil and a bleed control agent; and further, a plastic from which oil is released at a rate that is controlled by the amount of the bleed control agent incorporated into the polymeric void structure of the plastic. The term "thermoplastic" is used herein to refer to plastics that can be melted and injection molded or extruded to form structures that have the following "desirable properties", namely, LDP compositions that: (1) do not show signs of polymer segregation; (2) have good surface finish after molding or extrusion; (3) do not peel or pit; (4) have good flow characteristics when melted; and, (5) have a controlled rate of release of oil from within the PE polymeric composition that is dependent upon the amount of a bleed control agent in the LDP.

The following disclosure describes preparation and properties of LDPs formulated from polyethylene with a molecular weight (M.W.) of 200,000 M.W. to 700,000 M.W. Although polyethylene at this "very high" MW is generally considered difficult to mold or extrude, processes were discovered that allow LDPs with desirable properties to be formulated and processed. It was discovered that totally dissolving hydrocarbon-based oil in a polyethylene only softens the plastic and degrades mechanical properties without adding to tribological performance.

To solve this problem, methods were first investigated for creating a structure that would exclude oil from a polymer matrix into the void regions of the plastic polymer. It was discovered that mixing a PE powder of 200,000 M.W. to 700,000 M.W. with a hydrocarbon-based oil, then heating the mixture (with shear) to a state in which the oil was partly soluble in the polyethylene, and then cooling produced LDPs with highly desirable properties. Evidently, upon cooling, the solubility of the; oil was reduced, and the oil was rejected from the PE polymer into the void of the polymer lattice structure. However, despite the discovery of these desirable properties, the rate of release of the oil from the polymer structure was still not well controlled.

To solve this further problem, tests were next conducted with a variety of bleed control agents to determine whether: (a) the formulation with the agent would still allow the oil to partition in the void of the polymeric structure; (b) the agent would likewise be partitioned with the oil; (c) whether the agent could affect oil release from the polymer structure, i.e., whether it could act as a "bleed control agent"; and, (d) whether the rate of release of oil could be controlled by controlling the amount of the bleed control agent in the formulation. Successful testing and development of PE polymers incorporating bleed control agents are described in the Examples, below.

With respect to the polyethylenes useful in the formulations, process, and controlled-release lubricant compositions that are subjects of this invention, polyethylenes having M.W.s higher than 700,000 are not useful because they do not produce PE polymers with "desirable properties". In addition, polyethylenes with M.W.s much below 200,000 form solid solutions with oils that both degrade the mechanical properties of the composition and prevent proper bleeding of oil to the surface. Thus, the desirable polyethylenes for the invention have M.W.s greater than about 200,000 and less than about 700,000. Polypropylene having a melt flow rate of between 0.1 and 1 gram per minute may be mixed with the polyethylene powder or pellets. Polyethylenes are commonly available commercially as powders or pellets having a range of molecular weights. One representative example of a suitable PE powder is Hostalen GUR 7255P, manufactured by Hoechst Celanese Corporation.

The term "rate of oil release" is used interchangeably herein with "rate at which oil is released", and "rate of oil loss" to refer to the amount of oil appearing on the surface of an LDP as a function of time, e.g., conveniently measured as the % w/w or grams of oil exuded per hour onto the surface of the LDP. The rate of release may be conveniently measured in a variety of ways, one of which involves weighing a precalibrated filter paper after it has been saturated with oil released from an LDP over a measured period of time. In the representative Examples discussed below, rates of oil release are disclosed that encompass the initial rate of oil rejected from the PE polymer upon cooling (i.e., after molding or extrusion); the steady state rate at which the oil is exuded (depending on the type and quantity of bleed control agent added); and, the rate at which oil is expelled when heat is applied to the molded or extruded part. Representative examples of the subject lubricant dispensing plastics have rates of oil release that can all be controlled by varying the amount of the bleed control agent. Additional controls on oil release which are exemplified in the Examples herein include adjusting the oil viscosity, and selecting the initial content of oil in the LDP (i.e., % w/w oil). Using these adjustments, the rate of oil release can be further decreased to conform with an ambient temperature of LDP use (e.g., room temperature or a higher temperature characteristic of operating machinery). For example, LDPs formulated with 65% w/w polyethylene, 30% w/w ISO 320 oil, and 5% EVA 400A bleed control agent bled oil onto their surface at a rate of from 0.013% w/w per hour to 0.042% w/w per hour (FIG. 1), while LDPs with 75% w/w polyethylene, 20% w/w ISO-10 (Diala) oil, and 5% 400A bleed control agent released oil at a rate of from 0.023% w/w per hour to 0.025% w/w per hour (FIG. 2). The Examples that follow disclose controlled rates of oil release from LDPs by adjusting: (a) the concentration of the bleed control agent; (b) the oil viscosity; and, (c) the initial content of the oil in the LDP. Using the latter adjustments, LDPs may be formulated with different desired rates of oil release. The rate at which the oil is released from the subject LDPs of the invention is primarily determined by the amount of the bleed control agent added to the PE-oil formulation.

The term "bleed control agent" as used herein means an agent which, when incorporated into the structure of an LDP through compounding or dissolution in the oil, is capable of controlling the rate at which oil is extruded from the LDP. Representative examples of bleed control agents include low molecular weight polymers such as polyethylene-polypropylene copolymer (e.g., "V114"), ethylenevinyl acetate copolymer (e.g., EVA 400A), ethylene-acrylic acid copolymer (e.g., "540"), styrene-butadiene-styrene block copolymer, certain polyethylene waxes, certain oxidized polyethylene homopolymers (e.g., "649"), and other materials that have the property of gelling oil (e.g., materials used in manufacturing greases and cosmetics). Presently preferred bleed control agents for use with low ISO oil (e.g., ISO 10 Diala) include 400A, 540, and 629; and, for hydrocarbon-based oil of ISO 150-460, EVA 400A. A variable amount of a bleed control agent is incorporated into the formulations used to compound the subject LDPs.

In a representative example the bleed control agent is added to a level of between one-half and twenty percent of the total weight of the PE base polymer; and, in an amount sufficient to achieve the desired rate of oil release from the subject LDP. All of the subject bleed control agents of the invention have an additional property, namely, the rate at which a particular viscosity of oil is released from the extruded or molded subject PE LDPs is inversely proportional to the amount of bleed control agent added. The Examples show representative oil release rates obtained by incorporating different amounts of a bleed control agent into formulations having different initial oil contents and different viscosities of oil.

A formulation is made by mixing a PE powder (or pellet) with an oil and a bleed control agent. A representative formulation is made by mixing Hostalen GUR polymer powder with a hydrocarbon or ester lubricating oil (e.g., in ratios of between one part oil to ten parts polymer and fifteen parts oil to ten parts polymer), and variable amount of a bleed control agent, e.g., at least 40% w/w polyethylene. For example, polyethylene in the range of about 40% to about 87.5% w/w, 10% w/w to about 60% w/w of hydrocarbon oil, and the variable amount of a bleed control agent in the range of about 2.5% to about 15%, depending upon the rate of oil release desired. The presently preferred compositions are 65–90% w/w polyethylene, 5–40% w/w hydrocarbon oil, and 2.5–15% 400A bleed control agent. If polypropylene is mixed with the polyethylene the formulation preferably includes about 1% to about 15% w/w of polypropylene, and the amount of polyethylene is reduced by an amount equal to the amount of the polypropylene added.

Compounding of the subject LDPs is achieved by a variety of common methods used with thermoplastics, e.g., extrusion or injection molding. A representative compounding process for producing the subject compositions includes introducing the PE-oil-bleed control agent formulation into a plastics extruder where the formulation is heated under shear and extruded. Shear aids in the dispersion of the oil throughout the polymer and creates a more homogeneous product. The extruder combines the oil, polymer, and bleed control agent into a homogeneous mass, which is extruded as either a finished or semi-finished profile part, or as a thin strand of material that may be chopped into pellets for further processing (e.g., by extrusion or injection molding) into finished parts. Skilled artisans will recognize that the amount of shear and temperature can be adjusted to achieve homogenous incorporation of the components into the subject LDPs.

In certain embodiments of the invention, EVA (400A) was used as a bleed control agent at 5% or 10% w/w of PE base polymer and was incorporated into the polymer using high temperature (e.g., 200° C.) and shear. The resulting finished, semi-finished, or bulk raw materials have properties that cause partitioning of the entrapped oil and bleed control agent within the void of the polymeric structure of the LDP. The subject formulations and processes produce polyethylene LDPs in which the amount of the bleed control controls the rate of release of the oil, i.e., oil release rate is inversely proportional to the amount of bleed control agent in the formulation.

While not wishing to be limited to any particular mechanism identified as operative in achieving the features of the present invention, it is currently believed that the void structure in the lubricant-dispensing plastic polymer is created as follows. First, the lubricating oil is insoluble in the high molecular weight polymer at room temperature, bull is fully dissolved in the polymer due to the combined shearing action and high temperature in the extruder. Next, upon cooling, it is believed that the oil and bleed control agent are rejected from solution into a series of interconnected microscopic pores (the oil being trapped within the microporous structure). Finally, oil bleeds to the surface of the microporous structure by capillary action at a rate controlled by both the pore structure of the polymer and the entrapped bleed control agent. The bleed control agent is believed to act with the oil by forming a variable "gel" in the pores, and, depending on the type and amount of the bleed control agent present, the state of the gel is altered, thus reducing the rate at which the oil can flow through the micropores to the surface.

There is no carrier or adsorbent material for oil in the compositions of the invention.

The term "oil" is used herein to refer inclusively to hydrocarbon-based oils, ester oils, and other oils. "Hydrocarbon-based oils" form solid solutions with polyethylenes having M.W.s below about 200,000, in which the mechanical properties of the polyethylenes are degraded, and the oil does not readily bleed to the surface to provide the desired lubrication function. In contrast, polyethylenes of 200,000 M.W. to 700,000 MW. are suitable for formulating the subject LDPs with the controlled rates of oil release. A wide variety of hydrocarbon oils may be incorporated in the subject LDPs. Representative examples include hydrocarbon oils with viscosities in the range of 10 centiStokes (cSt) (e.g., Diala) to 400 cSt (ISO 400) at 40° C. LDPs incorporating oils with much lower viscosities (5 to 50 cSt) exhibit lower friction coefficients than the latter higher viscosity LDPs (e.g., friction when slid against themselves or against other surfaces). A low frictional coefficient is a desirable characteristic in some embodiments of the invention. The concentration of bleed control agent is adjusted to control the rate of oil loss from an LDP formulated with the latter low viscosity oils. Hydrocarbon oils with viscosities in the range of 5 to 50 cSt have a partial solubility in PE at room temperature (e.g., in GUR 7255P), and are also sufficiently volatile that they may exhibit undesirable loss through evaporation. Loss of surface oil through solubility and evaporation can theoretically reduce the effectiveness of an LDP, but if this loss is judged to negatively impact performance, certain ester oils and other synthetic oils may be used having both low viscosity and low volatility. Representative "ester oils" include the following: namely, polyol esters (e.g., Emery #2935); dimer esters (e.g., Emery #2900); glycerol monooleate (e.g., Emery #2421); dimethyl azelate (e.g., Emery #2983); idodecyl petargonate (e.g., Emery #2911); and, di-isodecyl adipate (e.g., Emery #2970; Emery Group of Henkel Corporation, Cincinnati, Ohio). The latter synthetic and ester oils are generally insoluble in polyethylenes (even at higher temperatures), but special formulation and compounding methods with a compatibilizing agent (e.g., a hydrocarbon oil) are disclosed below, for overcoming such solubility problems.

To compensate for the solubility characteristics of an oil in a 200–700,000 M.W. PE, the oil solubility can be altered by adding a "compatibilizing agent." The term "compatibilizing agent" is used herein to mean a substance which, when added in small percentages (e.g., 1% to 10% w/w) to an immiscible mixture of a polyethylene and an oil, will allow the mixture to be processed as if the polyethylene and the oil were completely miscible. For example, ester oils are good lubricants but have very limited solubility in a PE base polymer (even at high temperature) so that during extrusion it is often difficult to process the resulting slurry as a feedstock for extrusion. In one representative example of the use of a compatibilizing agent, a hydrocarbon mineral oil (i.e., Diala oil) was added as a "compatibilizing agent" for an ester oil that was insoluble in PE (i.e., Emery #2935 ester oil was miscible in the Diala oil but insoluble in PE). The LDPs that were extruded had a desired oil release rate (e.g., see Example 3, below) and the materials had very smooth and low-friction performance for such substituted compositions. As a second representative example of use of a compatibilizing agent, an ester oil (i.e., Emery #2935) was first mixed with a Diala mineral oil (ISO 10) as a compatibility agent, and then a bleed control agent was added (i.e., 400A EVA), the resultant mixture was added to a PE powder, and the oil-saturated PE paste was sufficiently sticky to allow it to successfully pass through the extruder and form an LDP. With 80% w/w PE, 5% Diala oil (as the compatibilizing agent) and 15% ester oil, 20% oil loading was achieved in the resultant polymeric LDP material, and the base paste mixture remained easily processable. The resultant LDP had excellent bleed characteristics (i.e., 10% to 20% over several months), with a low frictional coefficient (0.045–0.50) and good hardness (Shore D 58). Using 5% Diala oil (compatibilizing agent) and 15% ester oil, the mechanical properties of the LDP materials were not substantially different from those of other hydrocarbon-based (non-ester oil) self-lubricating compositions. Thus, a mineral oil in PE at high temperature and shear is a compatibilizing agent for an ester oil because it improves miscibility of the ester oil both during preparation of the mixtures for extrusion and during cooling following extrusion or compression molding of the polymer. Other examples of compatibilizing agents include materials that are mutually soluble in the ester oil and the polyethylene, such as polybutenes and polyalphaolefins.

The lubricant-dispensing properties of the subject LDP compositions can be further enhanced by modifying the PE polymeric pore structure. It has also been discovered that substituting polypropylene (PP) for a portion of the polyethylene created a more uniform microporous pore structure, as evidenced from scanning electron micrographs taken after the oil has been extracted from the composition. The subject PE-PP LDP compositions are obtained by adding a polypropylene having a melt flow rate of between 1.0 and 10 g/10 min. to an oil-PE formulation at an amount equal to between one and 15 percent of the total weight of the PE base polymer in the formulation as disclosed.

The process for molding or extruding the formulations of the subject LDPs involves controlling temperature and flow rate. The temperature history of the LDPs was discovered to be an important determinant of the amount of oil permanently dissolved into the PE and the amount entrapped in its structure and thus available to bleed. As an illustrative example, Diala petroleum oil has a degree of solubility in PE (Hoechst 7255) that depends on the time/temperature/shear history of the processing. The higher the temperature, and the longer the PE is exposed to that temperature, the greater is the amount of Diala oil permanently associated with the PE and not excluded into the pores. In the case of such Diala-containing LDPs, the temperature was controlled to obtain LDPs with desirable properties, and/or a bleed control agent (e.g., 400A EVA) was used to control the solubility of the oil in the PE. The amount of the bleed control agent in the formulation was adjusted so the oil was sufficiently dissolved in the PE base polymer to ensure that the sticky mass moved through the extruder barrel and was processed in a manner somewhat similar to an LDP compounded with only PE.

It was determined that brittleness was induced in the subject LDPs by shear when an obstruction in the flow path through the die allowed the LDP material in the center of the strand to move faster than the outer layers of strand material. The longer the residence time in the die, the more brittle the resultant LDP lubricant. It is thus desirable to take measures to provide the smoothest possible path, and to minimize shear during compounding of the subject LDPs.

Mixing the LDP formulations of oil-PE base polymer and bleed control agents will next be described. It was discovered that, when a full complement of oil was blended into a PE base polymer powder, i.e., 20–80% w/w, a somewhat sticky paste resulted that did not feed easily into an extruder. A two-step mixing process was used to overcome such problems. First, by completely blending all of the oil with a portion of the polymer powder and then extruding and pelletizing the composition, an oil-rich premix slurry was created that would feed (albeit slowly) in even a single-screw extruder. In this two step process, the slurry was first extruded and pellets prepared from the extruded strand. Second, the pellets were mixed with the balance of the powder. Trials showed that this two-step procedure produced a product that would feed properly in a twin-screw high-volume extruder.

Two different problems were commonly encountered in producing the oil-rich premix PE pellets. First, the oil-rich composition significantly reduced the output rate of a single screw extruder. Second, the oil-rich strand did not pelletize easily because the sticky pellets tended to jam the pelletizing machine. These problems were solved by mixing oil-rich pellets with powder and then adding the mixture to the remainder of the oil. The lower oil content in the powder allows the premix to flow easily. (For example, mixing was done in 58-pound batches in a 3-cubic-foot cement mixer.)

Scale-up and production of the oil-PE-bleed control agent formulations as feedstock suitable for production of the subject LDPs can be achieved using technology for high-speed production with feeders that can simultaneously meter the feed rates of the different powders and liquids into the extruders. The oil, PE base polymer, and bleed control agent may be metered simultaneously into the extruder, or alternatively, the PE and bleed control agent may be metered into the extruder and the oil may be injected into the throat of the extruder. Premixing processes (such as those described above) can also be used to prepare mixtures containing any two components selected from the group consisting of oil, PE, and bleed control agent, (e.g., PE+oil premix, or PE+bleed control premix, or bleed control agent+oil premix). The premix and a third component may be simultaneously and independently be introduced into the extruder.

Embodiments of the invention are useful in preparing self-lubricating wire cable, push-pull cables, bushings, bearings, lubricant pads and the like.

EXAMPLE 1

Figure 2:
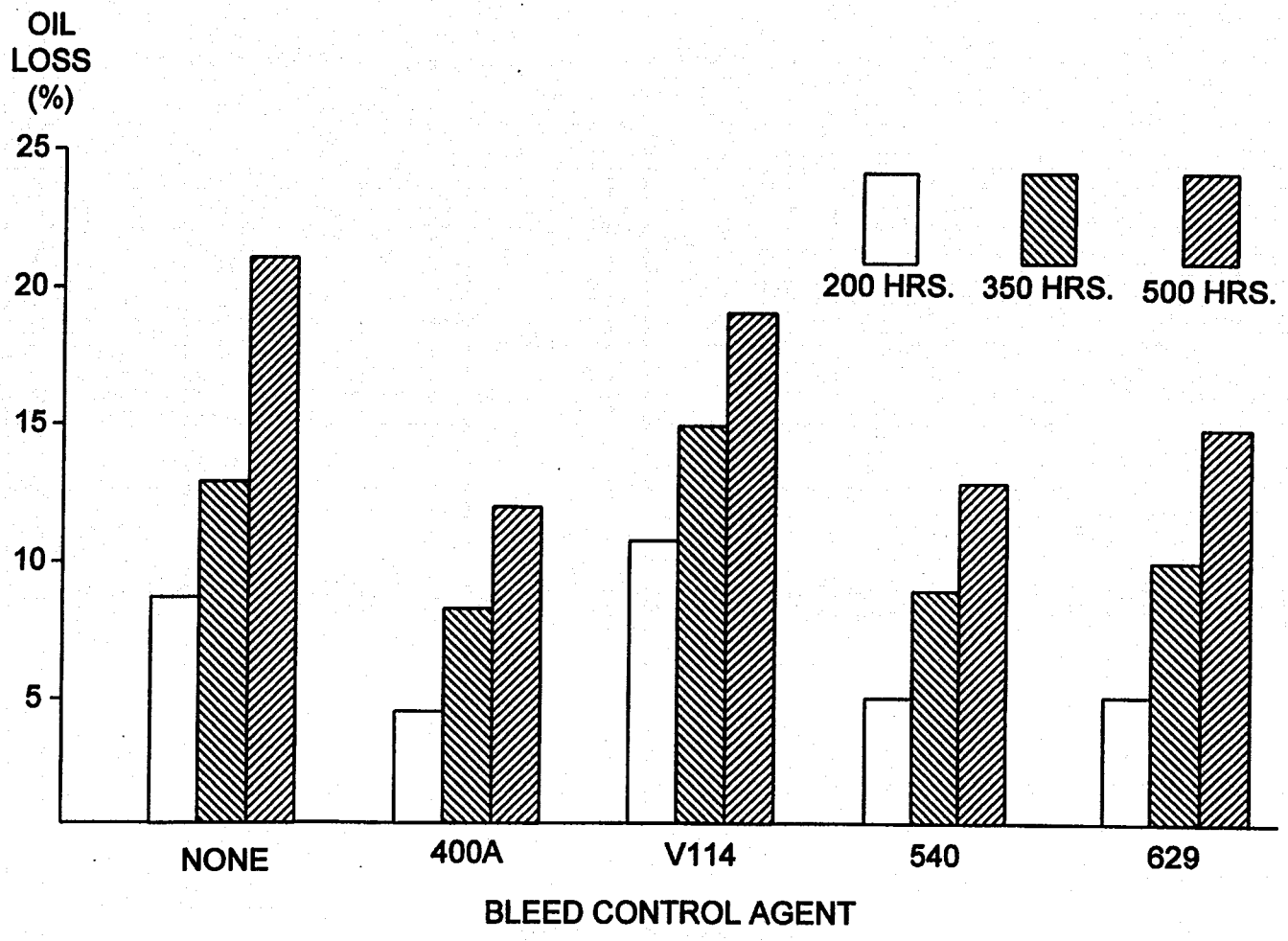
FIG. 2 graphically depicts the effect of the same four bleed control agents as in FIG. 1 at 5% w/w concentration, on the percentage of Diala oil (ISO 10) released over time at room temperature from a polyethylene lubricant dispensing plastic (75% w/w) with an original oil concentration of 20% by weight.

FIGS. 1 and 2 show the effect of four different types of bleed control agents on the bleed rate of oil from LDP specimens at room temperature. The LDP specimens were made with PE having a molecular weight of between 200,000 M.W. and 700,000 M.W. The PE was formulated with hydrocarbon ISO 320 (FIG. 1) and ISO 10 Diala (FIG. 2) lubricating oils and bleed control additives in various concentrations and then compounded by injection molding. To obtain oil bleed measurements specimens, $\frac{1}{8}\times\frac{1}{2}\times 4$ inches of each composition were injection molded. The specimens were weighed to an accuracy of $\pm 0.1$ mg and were then wiped free of all surface oil. They were weighed again and subsequently wiped and weighed at different times during an interval of 510 hours after molding, e.g., at 0 hrs., 90 hrs, 260 hrs, and 510 hrs after molding; as shown in FIG. 1. The percent oil loss was calculated from the reduction in weight, and the data are averaged from measurements made with three identical samples.

The effect of the four different bleed control agents, (i.e., 400A, V114, 540, and 629) on ISO 320 oil release was tested over 510 hrs. at room temperature (FIG. 1) or 500 hrs. at 45° C. (FIG. 2). Polyethylene materials were prepared that contained either 30% w/w oil (FIG. 1) or 20% w/w oil (FIG. 2), and the following bleed control agents: namely, 400A—an ethylene-vinyl acetate (EVA) copolymer obtained from Allied-Signal Inc., Morristown, N.J.; V114—a polyethylene-polypropylene copolymer obtained from Functional Products, Cleveland, Ohio; 540—an ethylene-acrylic acid copolymer obtained from Allied-Signal Inc., Morristown, N.J.; or, 629—an oxidized polyethylene homopolymer obtained from Allied-Signal Inc., Morristown, N.J.

The results presented in FIG. 1 show that adding 5% V114 to a composition containing 30% of a medium viscosity petroleum-based lubricating oil (ISO 320) provides 0.5% to 11.2% reduction in oil bleed from the polyethylene samples (65% w/w) after 90, 260, and 510 hours. FIG. 2 shows that adding 5% V114 to a composition containing 20% of a very low viscosity petroleum-based oil (Diala-ISO 10) provides similar reduction in oil bleed from the LDP materials. Progressively treater oil bleed reduction (i.e., 21.5% to 51.1% relative to compositions without bleed control agents) were recorded using 629, 540, and 400A as bleed control agents in different LDPs. At a concentration of 5%, the 400A agent reduced the oil release rate by about 42% to 50% for both the ISO 320 and Diala oil samples, (i.e., relative to samples with no bleed control agents). The range of rates of oil release from control samples of LDPs (no additive, FIGS. 1 and 2) was calculated to be about 0.022% w/w/per hour to 0.067% w/w oil per hour (FIG. 1) and 0.04% w/w oil per hour (FIG. 2), as compared with LDP samples formulated with 5% 400A as the bleed control agent that released oil within the range of about 0.013% w/w per hour to 0.042% w/w per hour (FIG. 1), and about 0.023% w/w per hour to 0.025% w/w per hour (FIG. 2). Similar reductions in the rate of oil release were obtained when the bleed control-containing LDP specimens were held at 114° F. for the periods of measurement, except that the total bleed rates; were higher than those at room temperature.

Figure 3:
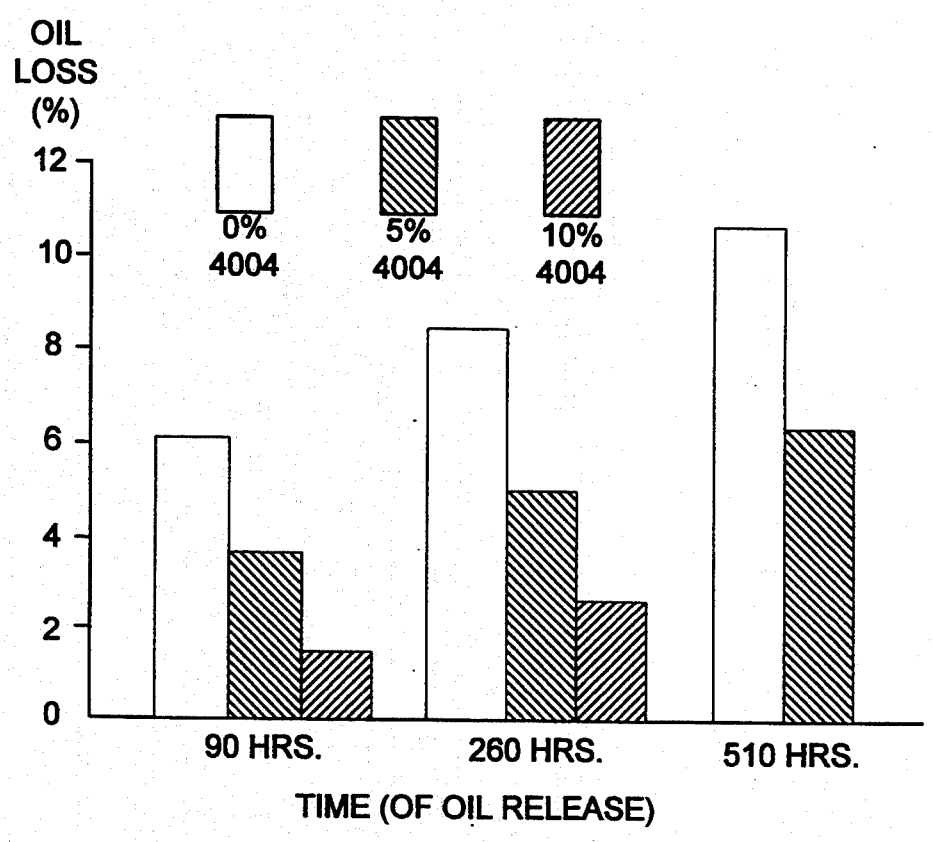
FIG. 3 graphically depicts the effects of two different concentrations of 400A bleed control agents (5% and 10% w/w) on the percentage of ISO 320 oil lost at room temperature from a polyethylene lubricant dispensing plastic (65% and 70% w/w) with an original oil concentration of 30% by weight.
Figure 4:
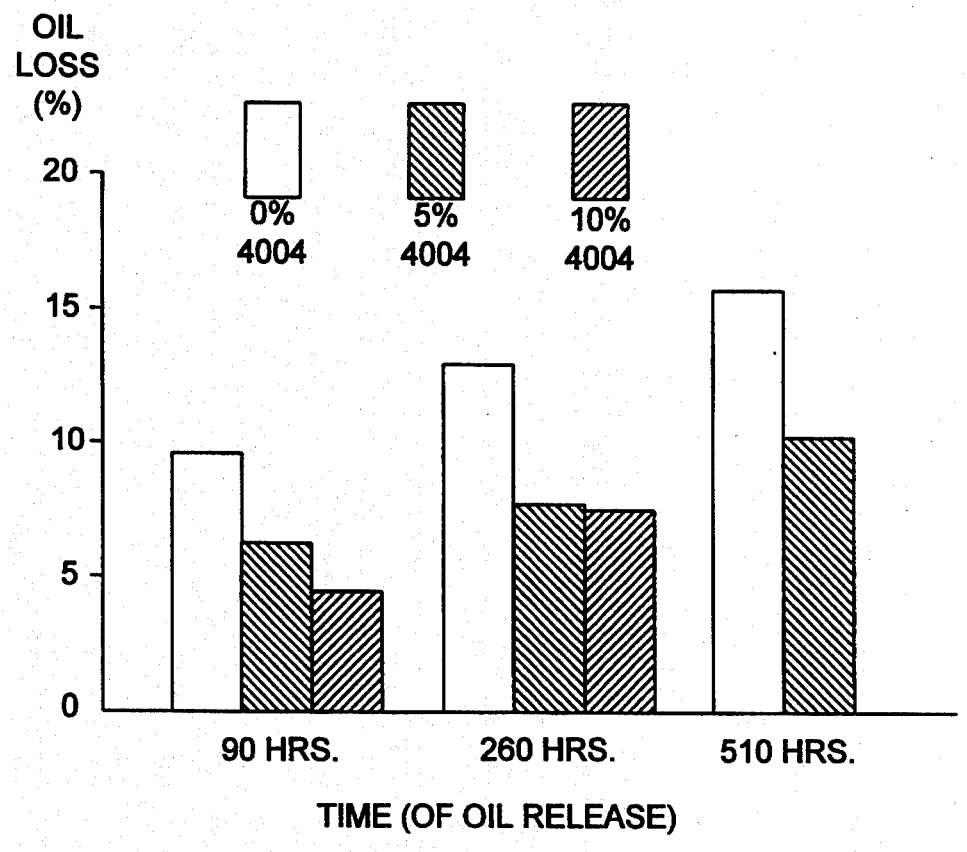
FIG. 4 graphically depicts the results obtained with the compositions of FIG. 3 at 45° C., rather than room temperature.

FIG. 3 shows the effect of two different concentrations of EVA 400A bleed control agent on the rate of oil release at room temperature. The LDP samples in FIG. 3 contained three different concentrations of the EVA 400A bleed control agent (i.e., 0%, 5%, or 10% w/w of total sample weight) and 320 ISO oil, and the testing was conducted at room temperature, after 90, 260, or 510 hours (FIG. 3). FIG. 4 shows the results obtained with the same LDPs (as in FIG. 3) but at a testing temperature of 45° C., i.e., instead of room temperature. From the results shown in FIG. 3, it was calculated that a concentration of 5% 400A reduced the oil release rate at room temperature by approximately 39% to 48% , and a concentration of 10% reduced the bleed by about 77% to 82%, both reductions being relative to samples with no additive. FIG. 4 shows similar effects at a temperature of 45° C.

The rate of oil release from the LDPs, described in the legends to FIGS. 3 and 4, is summarized in Table 1, below.

TABLE 1

Rate of Oil Loss at 5% or 10% w/w of Bleed Control Agent

| Bleed Control Agent (% w/w) | Time (hrs) | Rate of Oil Release (% w/w per hour) Room Temp. | 45° C. |
|---|---|---|---|
| None (0%) | 90 | 0.069 | 0.1 |
| | 260 | 0.032 | 0.05 |
| | 510 | 0.021 | 0.03 |
| EVA 400A (5%) | 90 | 0.042 | 0.07 |
| | 260 | 0.019 | 0.03 |
| | 510 | 0.012 | 0.02 |
| EVA 400A (10%) | 90 | 0.007 | 0.05 |
| | 260 | 0.011 | 0.03 |

Figure 5:
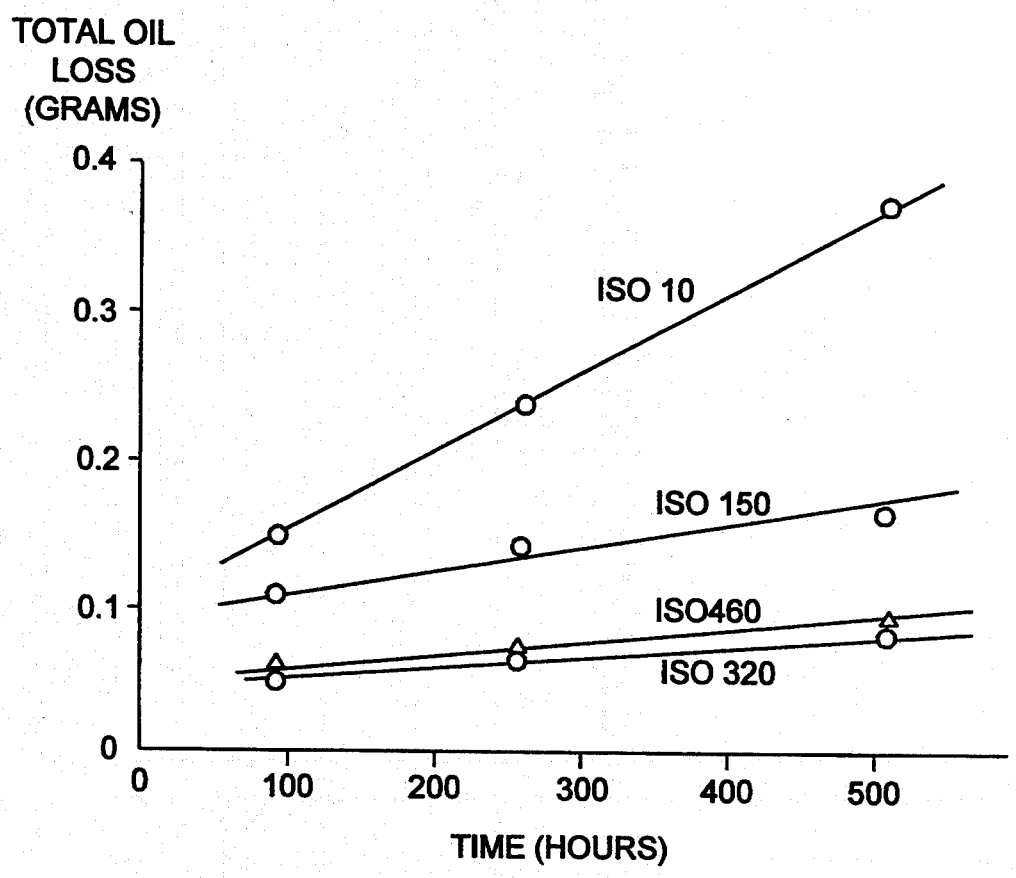
FIG. 5 graphically depicts the kinetics of oil loss at room temperature and the effects of oil viscosity on the rate of oil loss from polyethylene materials (65% w/w) containing 5% w/w of a bleed control agent (i.e., 400A) and 30% w/w oil.
Figure 6:
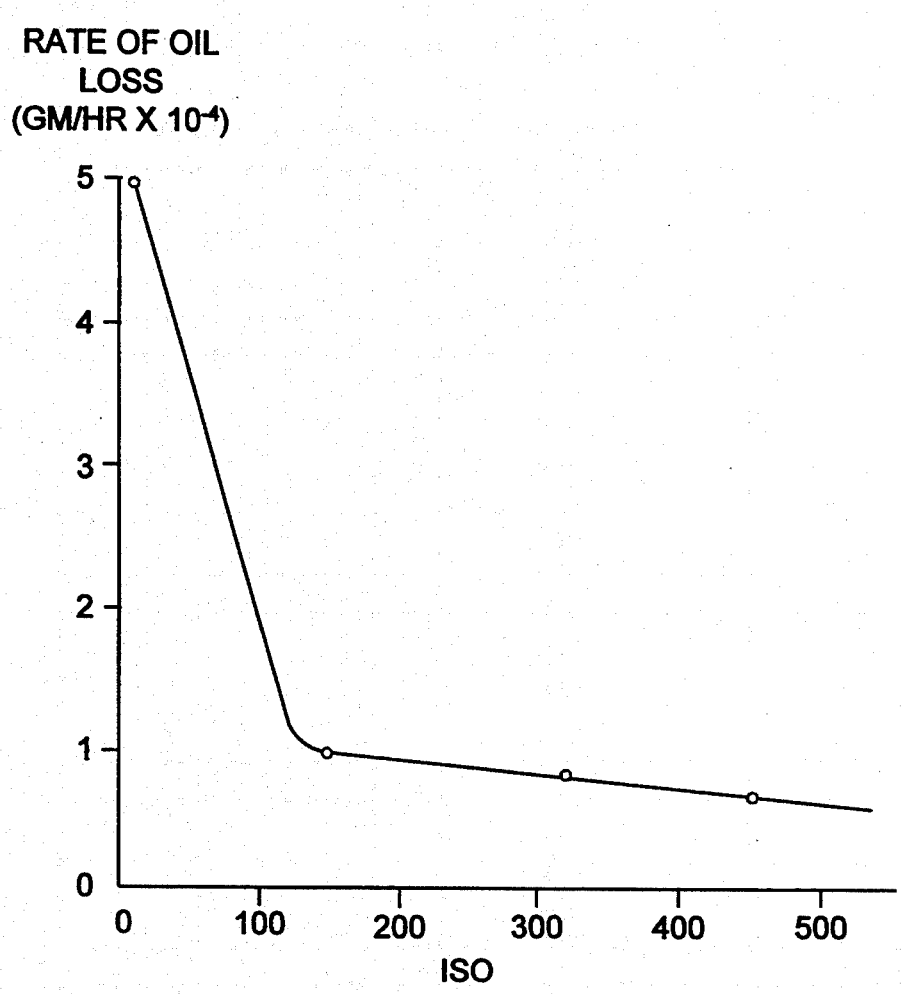
FIG. 6 graphically depicts the relationship between oil viscosity and the rate of oil release from the lubricant dispensing plastics of FIG. 5.

FIG. 5 shows the results obtained with LDPs formulated with 400A as the bleed control agent, and oils of differing viscosity (i.e., 10, 150, 320, or 460 ISO). Total oil loss (in grams) was measured from LDPs (65% w/w) formulated with 5% 400A as the bleed control agent and initially containing 30% w/w of oil. Oil loss was examined after 90 hrs., 260 hrs., or 510 hrs. at room temperature (FIG. 5). The relationship between the calculated rates of oil loss (data from FIG. 5) and oil viscosity is depicted graphically in FIG. 6. The results show that bleed control is achieved irrespective of the viscosity of the test oil, and point out the importance of bleed control agents in LDPs formulated with oil having viscosities of less than ISO 150.

Figure 7:
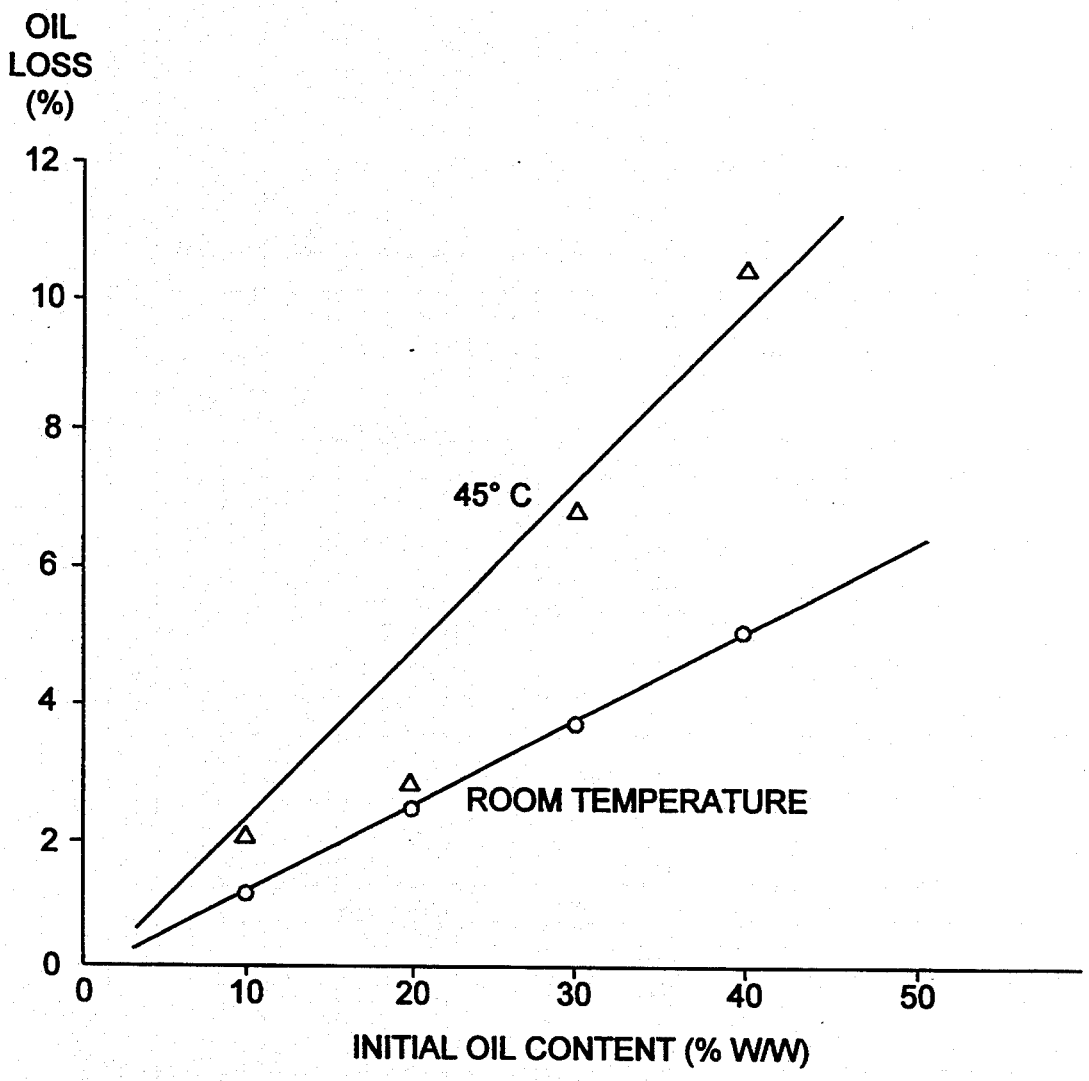
FIG. 7 graphically depicts the percentage of ISO 10 (Diala) oil loss after 500 hrs. at room temperature (large dots) and at 45° C. (open triangles), as a function of the total oil content (i.e., 10, 20, 30, and 40% w/w) of a lubricant dispensing plastic (LDP) containing 5% of a bleed control agent.

FIG. 7 graphically depicts the effect of holding oil viscosity constant (i.e., at ISO 10) and varying the initial oil content of an LDP. LDPs having four different initial oil contents were prepared (i.e., 10%, 20%, 30%, and 40%). The percent oil loss was determined (i.e., by wiping and weighing the LDP as described above) after 500 hrs. at room temperature or at 45° C. The results presented in FIG. 7 show that the percentage of oil lost from an LDP sample was directly proportional to the amount of oil into the original sample (i.e., in the range of 10% w/w to 40% w/w initial oil content).

Figure 8:
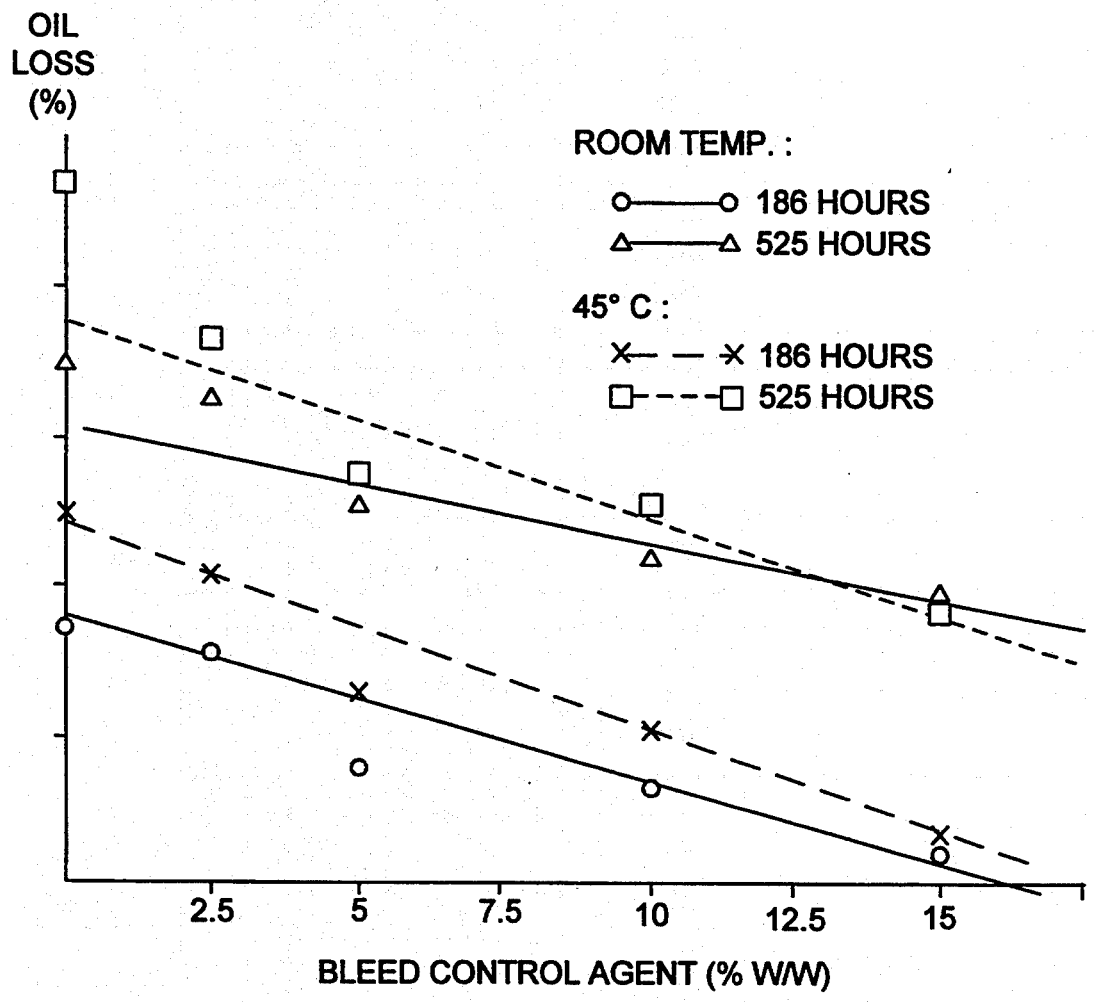
FIG. 8 graphically depicts the effects of varying the amount of bleed control agent (i.e., 0, 2.5%, 5%, 10%, and 15% w/w of 400A) on the percentage of oil loss at room temperature after 186 hours (large dots) and after 525 hours (open triangles), and at 45° C. after 186 hours (x—x) and after 525 hours (squares) from a polyethylene lubricant dispensing plastic initially containing 20% w/w ISO 10 (Diala); and, FIG. 9 graphically depicts the percentage reduction in oil loss, i.e., at room temperature after 186 hours (large dots), and after 525 hours (triangles) and at 45° C. after 186 hours (x—x) and after 525 hours (squares), that was achieved in the compositions of FIG. 8 containing a bleed control agent, as compared with oil loss from the same composition lacking the bleed control agent (shown in FIG. 8).
Figure 9:
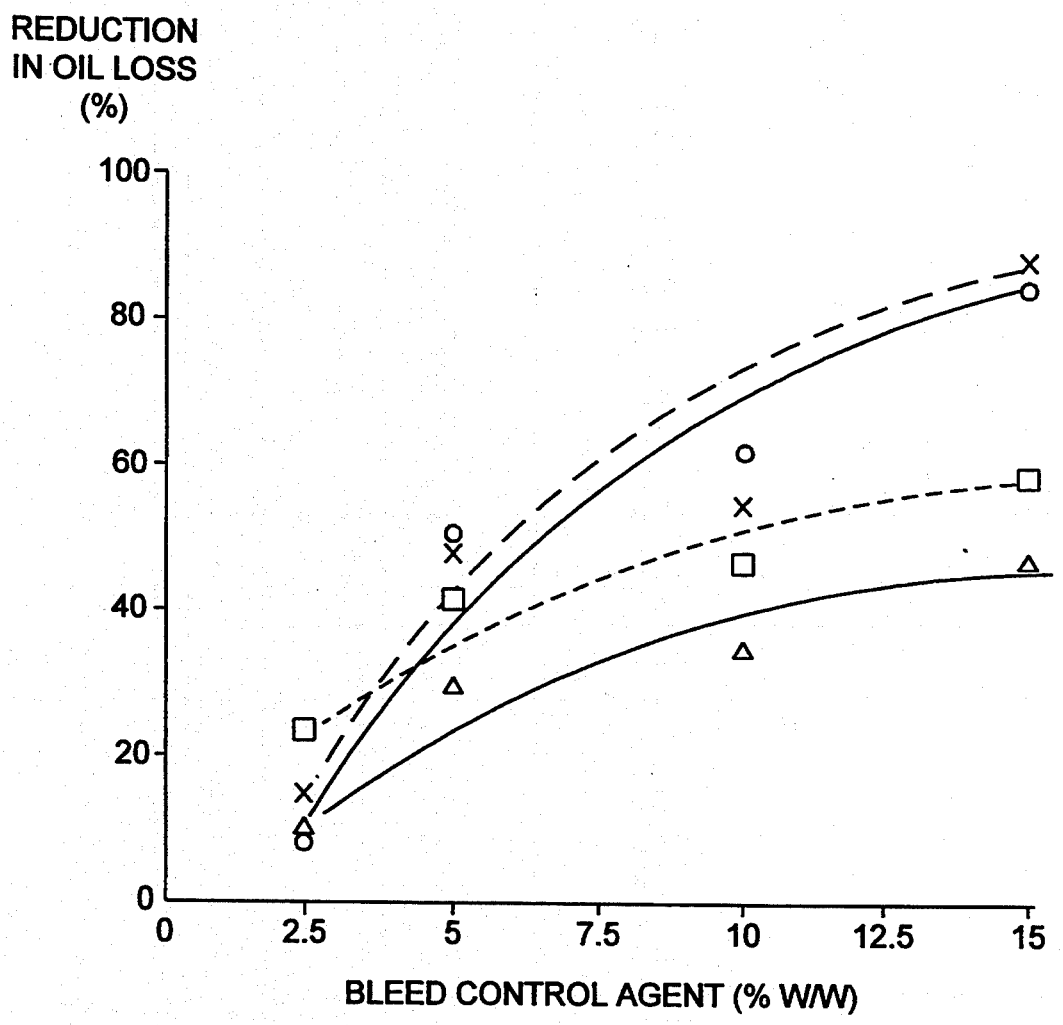

FIG. 8 graphically depicts the effects of holding oil viscosity (i.e., ISO 10) and an initial oil content of an LDP constant (i.e., at 20%) and varying the concentration of the bleed control agent in the LDP. LDPs were prepared containing four different concentrations of EVA 400A bleed control agent (i.e., 2.5%, 5%, 10%, and 15%) and oil loss was evaluated after 186 hrs. (closed circles) or 525 hrs. (triangles) at room temperature, or 186 hrs (x—x) or 525 hrs. (squares) at 45° C. The results shown in FIG. 8 define a linear relationship between the rate of oil loss and the % w/w of bleed control agent in the LDP. The percent reduction in oil loss (data from FIG. 8) as a function of the amount of bleed control agent in the LDP is presented in FIG. 9.

EXAMPLE 2

The mechanical properties of an oil-PE-bleed control agent LDP that make it useful as feedstock for extrusion and molding are shown in Table 2, below. The test formulation in this Example was 20% w/w ISO 320 oil, 75% PE (200,000–700,000 M.W.), and 5% w/w bleed control agent (EVA 400A).

TABLE 2

Desirable Mechanical Properties

| Property Measured | Result |
|---|---|
| Tensile Strength at Yield | 4088 psi |
| Elongation at Break | 76% |
| Tensile Modulus of Elasticity | 50,920 psi |
| Heat Deflection Temp | 127 F. |
| Compressive Strength | 686 psi |
| Compressive Modulus | 33,300 psi |
| Flexural Modulus | 58,100 psi |
| Flexural Strength | 2610 psi |
| Izod Impact | No Break V45 degrees |
| Hardness | 76/60 Rockwell/Shore D |
| Specific Gravity | 0.939 |
| Flammability | Pass |
| Thermal Expansion Coefficient | $24.3 \times 10^{-5}$ in/in/F |
| Coefficient of Friction | 0.045 against steel |
| Water Absorption | Nil |

EXAMPLE 3

In frictional wear tests conducted with steel or other metals, low viscosity oils such as Diala (ISO 10) were found to produce LDPs with lower frictional coefficients than higher viscosity oils like ISO 320. However, it was also observed that the low viscosity oils were more soluble in PE than the higher viscosity oils, and the mechanical properties (e.g., strength) of the LDPs were degraded by the low viscosity oil. LDPs prepared with the low viscosity oils were also susceptible to oil loss through evaporation. To overcome these problems, attention was focused on altering the solubility properties of the low viscosity oil in the PE. LDPs were formulated with ester oils that are insoluble in polyethylene, however, these formulations did not process through a compounding extruder. This problem was solved by adding a compatibilizing agent to the formulation. LDPs were compounded from the following formulation: namely, 15% w/w polyol ester oil with a viscosity of 23.1 cSt at 40° C. (Emery #2935; Emery Group, Henkel Corp.; Cincinnati, Ohio); 5% w/w Diala oil as a compatibilizing agent (Shell Oil Co.); 75% w/w PE powder (7255P); and, 5% w/w EVA 400A as the bleed control agent. The formulation was made stepwise by mixing the ester oil well with the compatibilizing agent, and then adding the PE powder and bleed control agent with adequate mixing so that a paste-like premix slurry was prepared for the extruder. The slurry mixture was compounded with heat and shear through the extruder and the product was pelletized. The pellets were next formed into strips $\frac{1}{8}\times\frac{1}{2}\times4$ inches, and the strips were tested for bleed rate (as described in Example 1, above) and frictional wear (as described in Example 2, above). In frictional measurements, the test strips (when slid against steel) exhibited substantially the same frictional coefficient (0.045) as a control LDP compounded without ester oil and containing 75% w/w PE, 5% 400A, and 20% w/w Diala oil. In oil release measurements, the test strips exhibited substantially the same rate of oil release (i.e., approximately 15% over 500 hours) as the control LDPs formulated with only 20% Diala oil. In mechanical and other tests (such as those summarized in Table 2, above) the ester oil-containing LDPs were the same (or superior) to the control LDPs containing only the Diala oil.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A solid lubricant-dispensing plastic having a controlled rate of oil release comprising: at least 40% w/w of a polyethylene having a molecular weight between 200,000 to 700,000; a hydrocarbon oil; and a predetermined percentage w/w of a bleed control agent, said bleed control agent comprising a solid polymer that is completely soluble in the hydrocarbon oil and which increases an apparent viscosity of the hydrocarbon oil as the predetermined percentage w/w of the bleed control agent is increased, said bleed control agent being soluble in and compatible with the polyethylene, wherein the predetermined percentage w/w of the bleed control agent that is used is selected to achieve a desired rate of oil release from the lubricant-dispensing plastic.

2. The lubricant-dispensing plastic of claim 1 which comprises 40% w/w to 87.5% w/w of the polyethylene, 10% w/w to 60% w/w of the hydrocarbon oil, 2.5% w/w to 15% w/w of the bleed control agent.

3. The lubricant-dispensing plastic of claim 1 which comprises 65–90% w/w polyethylene, 5–40% w/w hydrocarbon oil, and 2.5–15% of an ethylene-vinyl acetate copolymer as a bleed control agent.

4. The lubricant-dispensing plastic of claim 1, wherein the bleed control agent is selected from the group consisting of a polyethylene-polypropylene copolymer, an ethylene-vinyl acetate copolymer, an ethylene-acrylic acid copolymer, a styrene-butadiene styrene block copolymer, and an oxidized ethylene homopolymer, and a polyethylene wax.

5. The lubricant-dispensing plastic of claim 1, wherein the bleed control agent is included at a predetermined level of from 5% to 10% w/w and is effective to control the rate of oil release to a rate of from 0.007 to 0.42% w/w per hour over a period of 510 hours.

6. The lubricant-dispensing plastic of claim 5, wherein the rate of oil release is inversely proportional to the amount of bleed control agent added.

7. The lubricant-dispensing plastic of claim 1, wherein the bleed control agent is included at a predetermined level of from at least 10% to 20% w/w.

8. A solid lubricant-dispensing plastic having a controlled rate of oil release comprising: at least 40% w/w of a polyethylene having a molecular weight of between 200,000 and 700,000; an ester oil; a predetermined percentage w/w of a bleed control agent; and an oil compatibilizing agent, said bleed control agent comprising a solid polymer characterized by its complete solubility in the compatibilizing agent and by its ability to increase an apparent viscosity of a mixture of the ester oil and the compatibilizing agent as the predetermined percentage w/w of the bleed control agent added to the mixture is increased, wherein the predetermined percentage w/w of the bleed control agent that is used is selected to achieve a desired rate of oil release from the lubricant-dispensing plastic.

9. The lubricant-dispensing plastic of claim 8 which comprises 40% w/w to 86.5% w/w of the polyethylene, 10% w/w to 60% w/w of the ester oil, 2.5% w/w to 15% w/w of the bleed control agent and 1% to 10% w/w of the compatibilizing agent.

10. The lubricant-dispensing plastic of claim 8, wherein the ester oil is selected from among the group consisting of a polyol ester oil, a dimer ester oil, a glycerol monooleate ester oil, a dimethyl azelate ester oil, an idodecyl petargonate ester oil, and a diisodecyl adipate ester oil.

11. The lubricant-dispensing plastic of claim 8, wherein the bleed control agent is selected from the group consisting of a polyethylene-polypropylene copolymer, an ethylene-vinyl acetate copolymer, an ethylene-acrylic acid copolymer, a styrene-butadiene styrene block copolymer, an oxidized polyethylene homopolymer, and a polyethylene wax.

12. The lubricant-dispensing plastic of claim 8, wherein the compatibilizing agent is selected from the group consisting of a mineral oil, a polybutene, and a polyalpha olefin.

13. A method for preparing a lubricant-dispensing plastic, comprising the steps of:

mixing at least 40% w/w of a polyethylene having a molecular weight of between 200,000 and 700,000 with an oil and a bleed control agent, said bleed control agent comprising a solid polymer that is completely soluble in the oil and which increases an apparent viscosity of the oil;

heating and extruding the mixture; and, cooling the extruded mixture thereby forming the lubricant-dispensing plastic, the percentage w/w of the bleed control agent mixed into the lubricant-dispensing plastic controlling the rate at which the oil is released from the lubricant-dispensing plastic.

14. A method for preparing a lubricant-dispensing plastic, comprising the steps of:

mixing at least 40% w/w of a polyethylene having a molecular weight of between 200,000 and 700,000 with 1% w/w to 15% of a polypropylene having a melt flow rate between 1 and 10 grams per 10 minutes;

adding an oil and a bleed control agent to form a mixture, said bleed control agent comprising a solid polymer that is completely soluble in the oil and which is characterized by its ability to cause an increase in an apparent viscosity of the oil as the amount of the bleed control agent added is increased;

heating and extruding the mixture; and, cooling the extruded mixture thereby forming the lubricated-dispensing plastic, the percentage w/w of said bleed control agent added to the mixture controlling a rate at which the oil is released from the lubricant-dispensing plastic.

15. A method for preparing a lubricant-dispensing plastic, comprising the steps of mixing an oil, a compatibilizing agent, and a bleed control agent; adding a base polyethylene having a molecular weight of between 200,000 to 700,000 to form a mixture; heating and extruding the mixture; and, cooling the extruded mixture thereby forming the lubricant-dispensing plastic, said bleed control agent comprising a solid polymer that is completely soluble in the oil and which is characterized by its ability to cause an increase in an apparent viscosity of the oil as the amount of the bleed control agent in the mixture is increased, thereby controlling a rate at which the oil is released from the lubricant-dispensing plastic.

* * * * *